US005253942A

United States Patent [19]

Stokes

[11] Patent Number: 5,253,942

[45] Date of Patent: Oct. 19, 1993

[54] METHOD FOR APPLYING PAINT UPON SURFACES

[76] Inventor: Christine P. Stokes, 3462 S. 5100 West, Hooper, Utah 84315

[21] Appl. No.: 605,260

[22] Filed: May 18, 1984

[51] Int. Cl.[5] ..... B05D 1/26

[52] U.S. Cl. ..... 401/176; 222/386; 401/266; 401/82; 604/227

[58] Field of Search ..... 401/176, 266, 265, 261, 401/177, 179, 180, 181, 182, 82, 172; 604/218; 222/326, 386; 426/250, 383

[56] References Cited

U.S. PATENT DOCUMENTS

| | | | |
|---|---|---|---|
| 1,277,445 | 9/1918 | MacGregor | 604/227 |
| 1,913,466 | 6/1933 | Ackermans | 401/180 |
| 2,502,920 | 4/1950 | Brown | 426/250 X |
| 2,598,595 | 5/1952 | Peters | 426/250 X |
| 2,656,070 | 10/1953 | Linder | 401/266 X |
| 2,996,223 | 8/1961 | Dolezal et al. | 401/265 X |
| 3,212,685 | 10/1965 | Swan et al. | 401/172 X |
| 3,325,061 | 6/1967 | Ellsworth | 604/218 |
| 3,346,147 | 10/1967 | Higgins et al. | 222/326 |
| 3,536,411 | 10/1970 | Eisert | 401/266 X |
| 3,792,163 | 2/1974 | Fudro | 33/21 |
| 3,848,564 | 11/1974 | Kull | 118/13 |
| 3,993,409 | 11/1976 | Hart | 401/199 |
| 4,171,168 | 10/1979 | Braun | 401/261 X |

FOREIGN PATENT DOCUMENTS

| | | | |
|---|---|---|---|
| 824456 | 12/1951 | Fed. Rep. of Germany | 401/176 |
| 793826 | 2/1936 | France | 401/171 |
| 1049695 | 12/1953 | France | 401/82 |
| 1526245 | 4/1968 | France | 401/261 |

*Primary Examiner*—Steven A. Bratlie
*Attorney, Agent, or Firm*—A. Ray Osburn

[57] ABSTRACT

Method, and associated apparatus, for applying paint to surfaces for decorative purposes, wherein paint in a tubular barrel member is forced by manual pressure of a plunger through a small paint outlet tip onto the surfaces, generally in raised lines. The apparatus is easily operated and controlled by one hand, and the other is free to hold or manipulate the work piece.

3 Claims, 2 Drawing Sheets

METHOD FOR APPLYING PAINT UPON SURFACES

BACKGROUND OF THE INVENTION

1. Field

The field of the invention is manually-operated devices and corresponding methods for producing decorative markings of paint upon the surfaces of items such as eggs or Christmas tree ornaments, or upon canvas or the like.

2. State of the Art

The decoration of objects with patterns of paint, ink or other color mediums is a popular art form, and is perhaps best exemplified by decoration of eggs, for which mechanical aids for holding and rotating the egg to facilitate marking have even been developed. See U.S. Pat. Nos. 3,792,163 and 3,848,564. Similarly, and more pertinently to the present invention, considerable developmental effort has been directed toward marking devices. Pencil-like devices with colored marking cores of carbon, pigmented wax and the like are used. Liquid inks are used in a gamut of pens exemplified by U.S. Pat. No. 3,993,409, including ball points, and, possibly, hollow needle points such as used for ink drafting. All of these liquid applying devices in one way or another utilize lengthy torturous passages of capillary size, which prevent excessive flow of ink, and through which the ink is positively drawn by the action of the marking tip upon the surface. They cannot be used for paints, which do not flow freely, being instead quite viscous, even stiff.

For paints, conventional brushes are often used. These provide limited storage for the paint so that the brush must be repeatedly replenished to complete the desired designs. Very fine lines are very difficult to make, especially in extended lengths. Spatulas, knife points, even fingers are sometimes used, all sharing disadvantages similar to those of brushes. Further, the application of paint in uniform raised condition from the surface being decorated is extremely difficult with any of these devices.

BRIEF SUMMARY OF THE INVENTION

With the foregoing in mind, the aforesaid disadvantages in the prior art are eliminated or substantially alleviated by the present inventive apparatus and method. The apparatus comprises an elongate tubular barrel, an elongate plunger within the barrel, and a nozzle assembly secured to one end of the barrel, said nozzle assembly having a hollow paint outlet tip, through which paint placed in the body is forced by the plunger onto a surface to be decorated. Preferably, the applicator is of proper length to be held within the hand, with the end of the plunger in the palm and the nozzle end gripped by thumb, index and middle fingers, which apply force on the barrel toward the palm. The rate of flow of paint is adjusted by the amount of force thus applied upon the plunger. The applicator may be operated with a single hand, leaving the other free to hold and perhaps manipulate the work piece being decorated.

The inventive method comprises providing such a paint applicator, providing paint therein, and applying the paint to the work piece as above described. The work piece may be stationary or may be provided with complimentary motions to that of the applicator if desired, as by use of holding and rotating devices.

It is therefore an object of the invention to provide a simple but improved device and method for applying paint upon a surface desired to be decorated.

BRIEF DESCRIPTION OF THE DRAWINGS

In the drawings, which represent the best mode presently contemplated for carrying out the invention.

DETAILED DESCRIPTION OF ILLUSTRATED EMBODIMENTS

Figure 1:
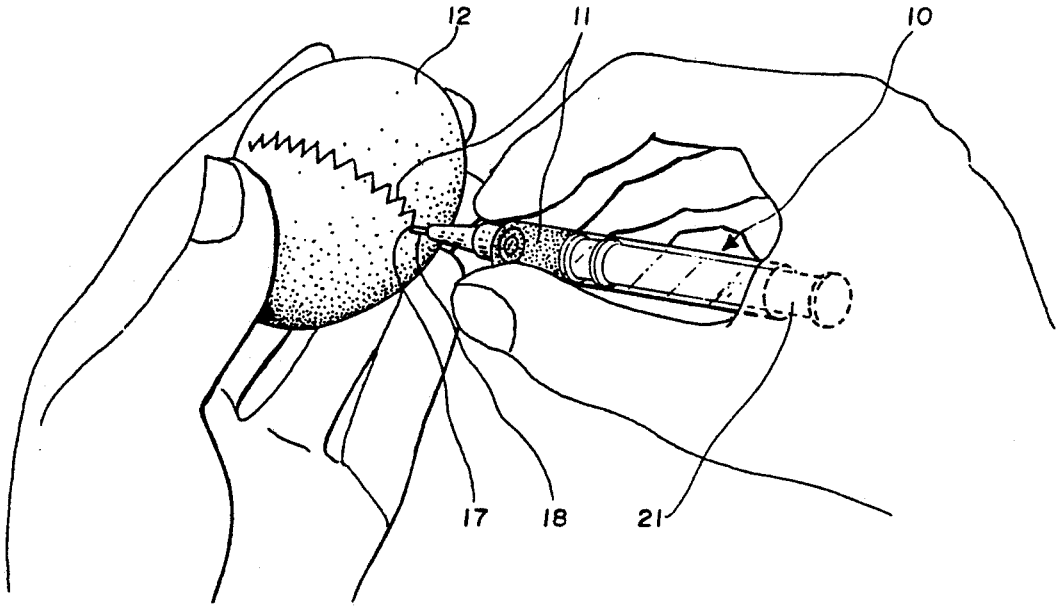
FIG. 1 is a perspective drawing of a plungered paint applicator in accordance with the invention, in use providing a line of raised paint upon an egg held in the operator's other hand, drawn to substantially full scale, FIG. 2 a side view of the paint applicator of FIG. 1, partially cut away, drawn to an enlarged scale, FIG. 3 a view of the applicator of FIG. 1 being held in the hand of the operator in a different manner, drawn to a reduced scale, FIG. 4 the paint applicator of FIG. 1 shown being held in the hand of the operator in still another manner, drawn to the scale of FIG. 3, FIG. 5 an elevation view of a fragment of the applicator of FIG. 1 including a blunt rounded paint outlet tip, said fragment being shown depositing a line of paint from the outlet tip upon a work piece, drawn to an enlarged scale, FIG. 6 a fragment of an applicator according to FIG. 1 including a transversely bevelled paint outlet tip, said tip being shown depositing lines of paint upon a work piece, drawn to the scale of FIG. 5, FIG. 7 a fragment of the applicator of FIG. 1 including a flattened paint outlet tip, said tip being shown depositing a band of paint upon a work piece, FIG. 8 a top plan view of the applicator fragment and paint line of FIG. 5, taken along line 8—8 thereof, drawn to the same scale, FIG. 9 a top plan view of the applicator fragment and the parallel paint lines of FIG. 6, taken along line 9—9 thereof, drawn to the same scale, FIG. 10 a top plan view of the applicator fragment and paint band of FIG. 7, taken along line 10—10 thereof, drawn to the same scale, FIG. 11 a vertical cross sectional view of a fragment of the work piece and paint line of FIG. 8, taken along line 11—11 thereof, drawn to the same scale, FIG. 12 a vertical cross sectional view of a fragment of the paint lines and work piece of FIG. 9, taken along line 12—12 thereof, drawn to the same scale, and FIG. 13 a vertical cross sectional view of a fragment of the paint band and work piece of FIG. 10, taken along line 13—13 thereof, drawn to the same scale.

In FIG. 1, paint applicator 10 is shown being operated by one hand of the operator to produce patterns of raised paint 11 upon the surface of, for example, an egg 12 held and perhaps manipulated by the operator's other hand. Applicator 10 may also be used in the manner shown to decorate objects held and manipulated by mechanical devices such as described previously herein and to apply paint to conventional canvasses and the like.

Figure 2:
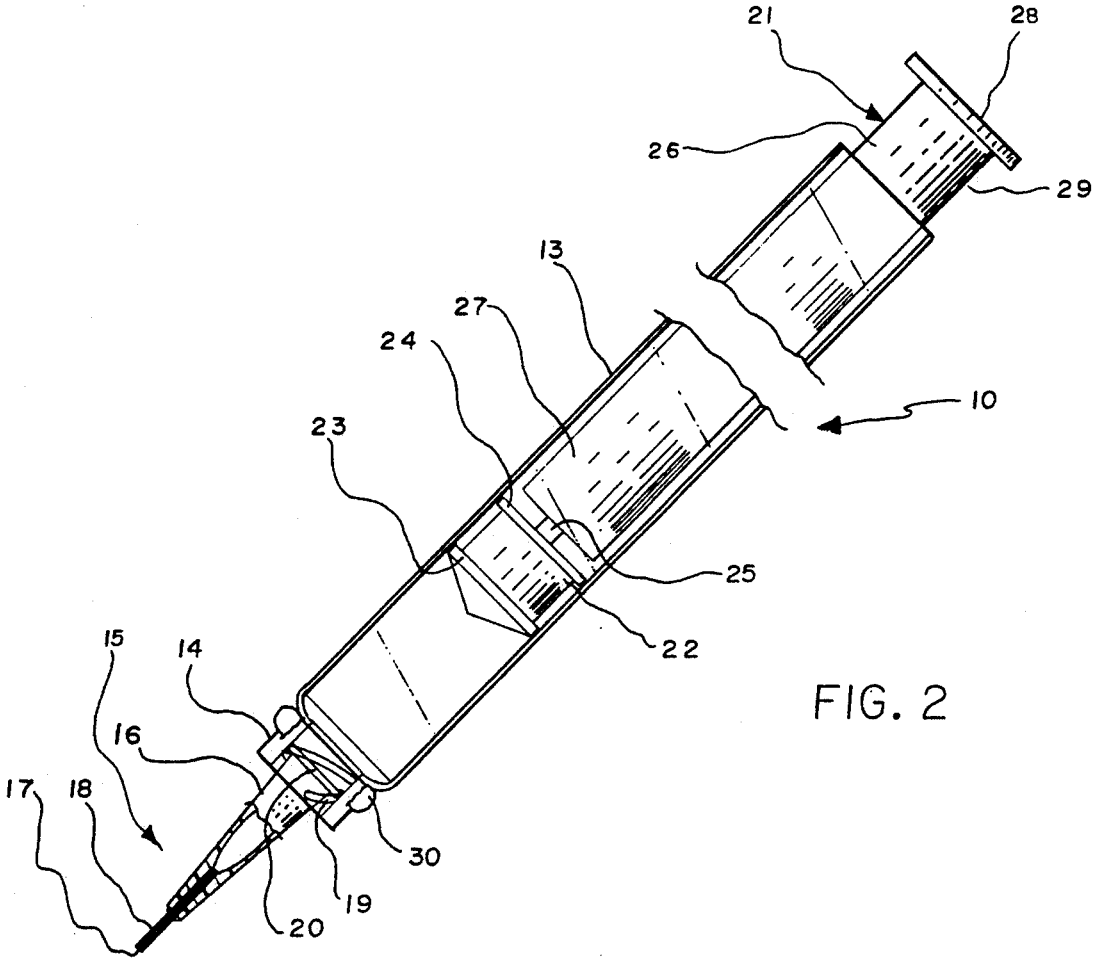

Applicator 10 comprises an elongate tubular barrel 13, preferably transparent so that its contents may be seen, which has at one end a nozzle connector portion 14 to which is secured an outlet nozzle assembly 15. (FIG. 2) Nozzle assembly 15 comprises a body portion 16 and terminates in a paint outlet tip 17, which may, for example, be a short hollow needle stub 18 with a blunt rounded tip. Nozzle assembly 15 may be secured to connector 14 of barrel 13 by means of internal threads 19 in connector 14 which engage flange ears 20 on nozzle body 16. An elongate plunger assembly 21 within barrel 13 has a soft elastic piston 22 with forward and rearward wiping flanges 23 and 24 respectively. Piston 22 is secured rotatably upon a pin 25 secured to an elongate plunger stem 26 at its end 27 inside barrel 13. Plunger 21 has an actuation pad 28 at its end 29 exterior to barrel 13. The paint 11 is placed within barrel 13 downstream of piston 22, which urges the paint 11 toward nozzle assembly 15, and out of paint outlet tip 17 as plunger 21 is depressed.

Much of applicator 10 as illustrated is quite similar to the familiar hypodermic needle assemblies in common medical use. However, it differs markedly in that needle 18 is greatly abbreviated in length compared to hypodermic needles. The painter may grasp applicator 10 quite near to the marking tip 17, providing required control not possible with hypodermic length needles, which are also undesirably flexible because of their excessive length. The needles are very small, which permits very fine lines to be made but which tends to strongly resist the flow of the viscous paint. The use of very short stub needles permits sufficiently free flow without unmanageable pressure upon plunger 21. Also, marking tip 17 is preferably not sharp, but rounded for smooth travel across the surface without snagging and the like.

The illustrated version of applicator 10 may be essentially produced by severing the needle of a hypodermic assembly of suitable barrel length, leaving the needle stub 18 attached to the nozzle body 16, followed by shaping the severed end of the stub to provide the desirous outlet tip configuration. Applicator 10 may of course be constructed by other methods, and from other materials without departing from the spirit of the invention.

Figure 5:
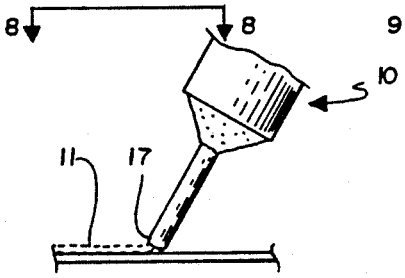
Figure 6:
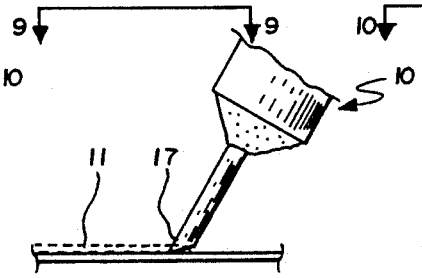
Figure 7:
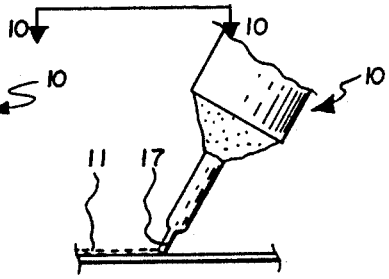
Figure 8:
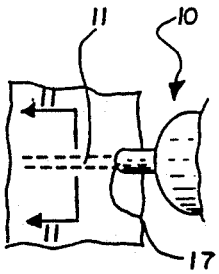
Figure 9:
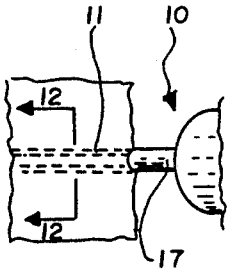
Figure 10:
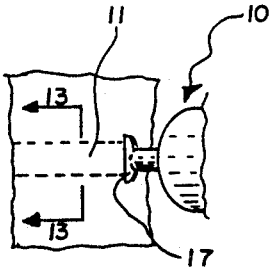
Figure 11:
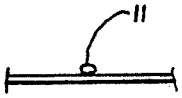
Figure 12:
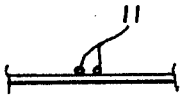
Figure 13:
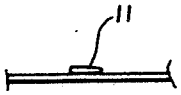

It has been found that needles at least in the range of 8 to 27 gauge may be readily utilized. Oil and water base paints of ordinary thickness and viscosity flow at sufficient rate through such small diameter needle stubs with easily applied pressure upon plunger 21. When a blunt, rounded needle tip 17 is used, the paint 11 is deposited as an upstanding, cord-like line of paint, as tip 17 is moved across the surface of the work piece, raised higher or lower depending upon the stiffness of the paint 11. (FIGS. 5,8 and 11) Very fine raised lines and patterns may easily be created upon a surface. Larger needles produce coarser lines. The skilled operator may however effect considerable variation in line thickness by varying the speed of the marking tip 17 upon the work piece and the pressure upon plunger 21. Faster tip speeds tend to produce finer lines, as do decreased plunger pressure decreasing the rate of flow of paint from the tip. The lines, coarse or fine, require little paint, so that no more than about ⅜ to ½" of barrel 13 ordinarily need be filled. While the blunt, rounded marking tip 17 has many advantages, other tip configurations may be employed to achieve other line characteristics. For example, a bevelled tip 17 tends to separate the paint into two parallel lines. (FIGS. 6,9 and 12) A tubular tip 17 with a flattened end has a generally oblong exit tip 17, which produces a broader, less raised line. (FIGS. 7, 10 and 13) A variety of configurations and structures may thus be employed for marking tip 17 without departing from the essential spirit of the invention.

Figure 3:
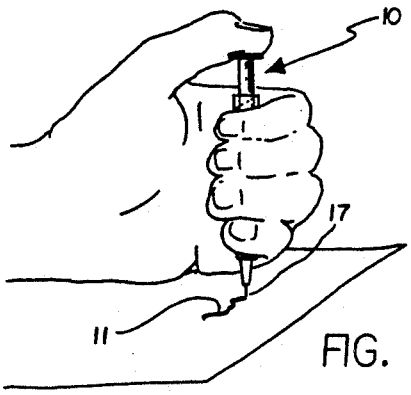
Figure 4:
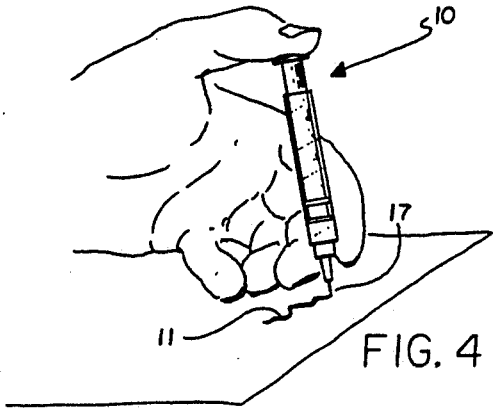

Applicator 10 may be gripped in any manner which permits the painter to depress plunger 21 into barrel 13 to provide a flow of paint from outlet tip 17 as the painter causes it to trace the desired pattern upon the work piece. Barrel 13 may be gripped in the fist, and plunger 21 depressed by the thumb. (FIG. 3) Or, barrel 13 may be held between the index and middle fingers, with plunger 10 depressed by the thumb. (FIG. 4) With another method, not illustrated, actuation pad 28 is anchored into the skin fold between the knuckles of the thumb and forefinger, with the barrel 13 gripped by the thumb, index and middle fingers, very much as a pencil is often gripped. However, gripping barrel 13 by the thumb, index and middle finger in the vicinity of nozzle connector 14, with pad 28 planted centrally upon the palm, best achieves steady pressure on plunger 21 which produces uniform paint flow, along with ready control of marking point 17. The thumb and fingers urge barrel 13 toward the palm to depress plunger 21. (FIG. 1) For most precise control of paint outlet tip 17, the fingers and thumb should grip very close marking tip 17, as upon nozzle body 16 or nozzle connector 14. It is therefore preferred that barrel 13 be short enough to be comfortably accommodated within the hand to permit gripping near tip 17, but not so short as to cause uncomfortable cramping of the fingers. It has been found that 2½"–3" is comfortable for most adult hands.

It is advantageous to provide a slip resistant surface at the finger contact points. If a modified hypodermic needle assembly is utilized, an ordinary "O"ring 30 of proper size stretched around nozzle connector 14 is very satisfactory. (FIG . 2) Other types of gripping aids could be provided, such as radial tabs or the like, not illustrated, at the nozzle end of barrel 13.

Although the embodiment of application 10 illustrated and described utilizes a tubular steel point outlet tip, and is otherwise generally similar to a medical hypodermic syringe assembly, other constructions providing short, small diameter outlet passages would be entirely within the spirit of the invention. For example, the barrel and nozzle assemblies could be a single, integral unit of, say, molded plastic, including the paint outlet tip and passage. The inventive apparatus may be embodied in other specific forms, and the method in other specific steps, without departing from the spirit or essential characteristics thereof. The present apparatus and method are therefore to be considered illustrative and not restrictive, the scope of the invention being indicated by the appended claims rather than by the foregoing description and all changes which come within the meaning and range of equivalency of the claims are therefore intended to be embraced therein.

I claim:

1. A method of applying paint to the surface of an object to be decorated, comprising the steps:

providing a medical hypodermic plungered syringe assembly having a barrel in the approximate length of 2½ to 3", a plunger within the barrel, and a nozzle assembly having a nozzle body secured at one of its ends to one end of the barrel, and terminating at its other end in an elongate, sharp ended tubular needle;

severing said needle at a location in the approximate range of ⅛ to ⅜" from the nozzle body and shaping the exterior end of the portion remaining attached to the nozzle body so as to provide a paint outlet tip of desired configuration;

providing a quantity of the paint within said barrel between the plunger and the nozzle body;

grasping said device in one hand and placing the paint outlet tip of the nozzle upon the surface to be decorated with the paint; and causing relative motion between the paint outlet tip and the surface while applying force by said hand upon the exterior end of the plunger to cause the paint to flow from the outlet tip onto the surface.

2. The method of claim 1, wherein:

the needle is in the range of 8 gauge to 27 gauge steel tubing.

3. The method of claim 1, wherein:

the barrel of the device is gripped by the thumb, forefinger, and middle fingers of the hand, and the exterior end of the plunger is seated against the palm of the hand; and force is applied upon the exterior end of the plunger by force upon the barrel by the thumb and fingers directed toward the palm.

* * * * *